US006526963B2

(12) United States Patent
Hoshowski

(10) Patent No.: US 6,526,963 B2
(45) Date of Patent: Mar. 4, 2003

(54) METHOD AND APPARATUS FOR PROTECTING A STOVE CONTROL PANEL FROM SPLATTER

(76) Inventor: Rose Hoshowski, R.R. #1, Thorsby, Alberta (CA), T0C 2P0

( * ) Notice: Subject to any disclaimer, the term of this patent is extended or adjusted under 35 U.S.C. 154(b) by 0 days.

(21) Appl. No.: 10/107,505

(22) Filed: Mar. 26, 2002

(65) Prior Publication Data

US 2002/0179083 A1 Dec. 5, 2002

(30) Foreign Application Priority Data

May 31, 2001 (CA) ..... 2349316

(51) Int. Cl.[7] ..... F24C 3/12
(52) U.S. Cl. ..... 126/42
(58) Field of Search ..... 126/42, 211; 369/75, 369/75.1

(56) References Cited

U.S. PATENT DOCUMENTS 4,157,705 A 6/1979 Caan ..... 126/211
4,836,181 A 6/1989 Saga ..... 126/42
4,964,393 A 10/1990 Knudsen ..... 126/211
5,040,162 A 8/1991 De Rozarieux ..... 369/75.1
5,357,942 A 10/1994 Williams et al. ..... 126/211
5,438,974 A 8/1995 Maldonado ..... 126/42
5,615,667 A 4/1997 Seeley et al. ..... 126/42

OTHER PUBLICATIONS

Computer printout of US Design 0325249—Splash Guard, Elbert J. Kliebert, Apr. 7, 1992.
Computer printout of US Design 0346529—Stove Panel Guard, Maglena Honaker, May 3, 1994.
Computer printout of US Design 0347550 Electric Range Control Panel Cover, Ralph S. Boone, Jun. 7, 1994.

*Primary Examiner*—Henry Bennett
*Assistant Examiner*—S. Dagostino
(74) *Attorney, Agent, or Firm*—Davis & Bujold, P.L.L.C.

(57) ABSTRACT

A method for protecting a stove control panel from splatter. A first step involves providing a precut flexible transparent heat resistant polymer film adapted to conform to an underlying form. The polymer film has peripheral edges adapted to adhere to an underlying surface. A second step involves covering the stove control panel with the polymer film and securing the peripheral edges of the polymer film to peripheral edges of the stove control panel.

7 Claims, 3 Drawing Sheets

METHOD AND APPARATUS FOR PROTECTING A STOVE CONTROL PANEL FROM SPLATTER

FIELD OF THE INVENTION

The present invention relates to a method and apparatus for protecting a stove control panel from splatter.

BACKGROUND OF THE INVENTION

There are some foods which tend to splatter when boiled or fried on stove top elements or burners. When cooking such foods, food or grease unavoidably splatters onto the stove top. The most difficult area of the stove top to clean is the control panel.

Numerous transparent guards have been developed to protect the control panel of a stove from splatter. Examples of such transparent guards are: U.S. Pat. No. 4,157,705 (Caan); U.S. Pat. No. Des 347,550 (Boone); U.S. Pat. No. 5,040,162 (De Rozarieux et al); U.S. Pat. No. Des 325,249 (Kliebert); U.S. Pat. No. 5,615,667 (Seeley et al); U.S. Pat. No. Des 346,529 (Honaker); and U.S. Pat. No. 5,357,942 (Williams et al). Each of the above patent references disclose a different configuration of rigid guard made from plastic or glass. Stove top splatters strike the guard. The guard has a smooth surface which is easier to clean than the control panel. The guard remains in place, even when not required.

SUMMARY OF THE INVENTION

What is required is an alternative method and apparatus for protecting a stove control panel from splatter.

According to one aspect of the present invention there is provided a method for protecting a stove control panel from splatter. A first step involves providing a precut flexible transparent heat resistant polymer film adapted to conform to an underlying form. The polymer film has peripheral edges adapted to adhere to an underlying surface. A second step involves covering the stove control panel with the polymer film and securing the peripheral edges of the polymer film to peripheral edges of the stove control panel.

The method, as described above, teaches the use of a disposable form of protective film that can be thrown away when it becomes soiled with splatter or is no longer required.

According to another aspect of the present invention there is provided an apparatus for protecting a stove control panel from splatter which includes a flexible transparent heat resistant polymer film adapted to conform to an underlying form. The polymer film is precut to dimensions substantially the same as the stove control panel. The polymer film has peripheral edges adapted to adhere to an underlying surface.

The apparatus, as described above, is a protective film that is adapted for use as stove control panel guards. It is preferred that a plurality of disposable protective films be dispensed in containers. There are various "containers" that can be used in dispensing these protective films. The protective films can be precut and dispensed from boxes or bags. They can also be dispensed in rolls and precut with perforations so that individual protective films can be torn from the rolls. There are various ways in which the peripheral edges can be adapted to adhere to the stove control panels. The polymer films can have adhesive along the peripheral edges, with the adhesive being covered with strips until required. The polymer films can have "cling" qualities, so that when stretched into position they cling to the stove control panel. An elastic can be placed along the peripheral edge, that holds the polymer film in place.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
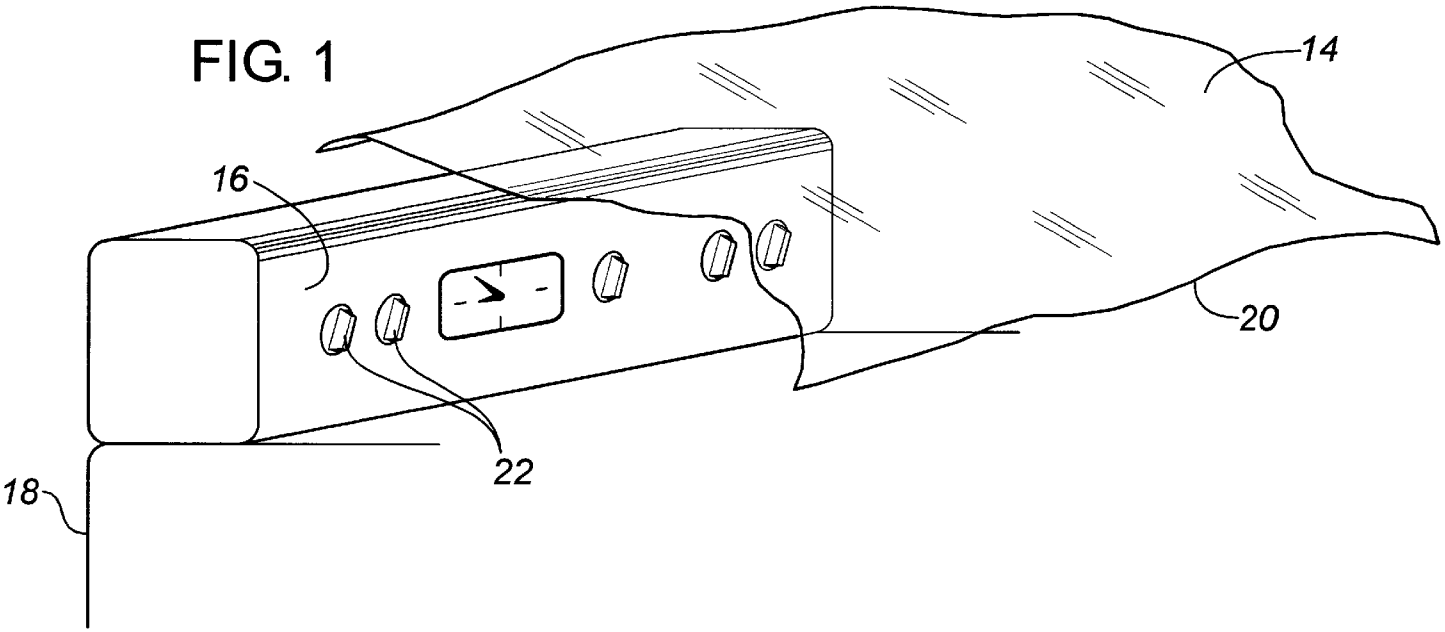
FIG. 1 is an exploded perspective view of a stove control panel guard in accordance with the teachings of the present invention being positioned on a stove control panel.

The preferred embodiment, an apparatus for protecting a stove control panel from splatter, hereinafter called a stove control panel guard and generally identified by reference numeral 10, will now be described with reference to FIGS. 1 through 6.

Figure 2:
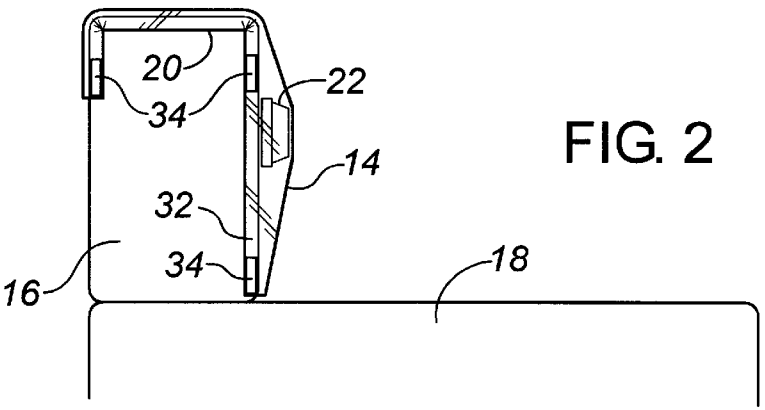
FIG. 2 is an end elevation view of the stove control panel guard illustrated in FIG. 1, secured to the stove top control panel by adhesive with tear away protective strips.
Figure 3:
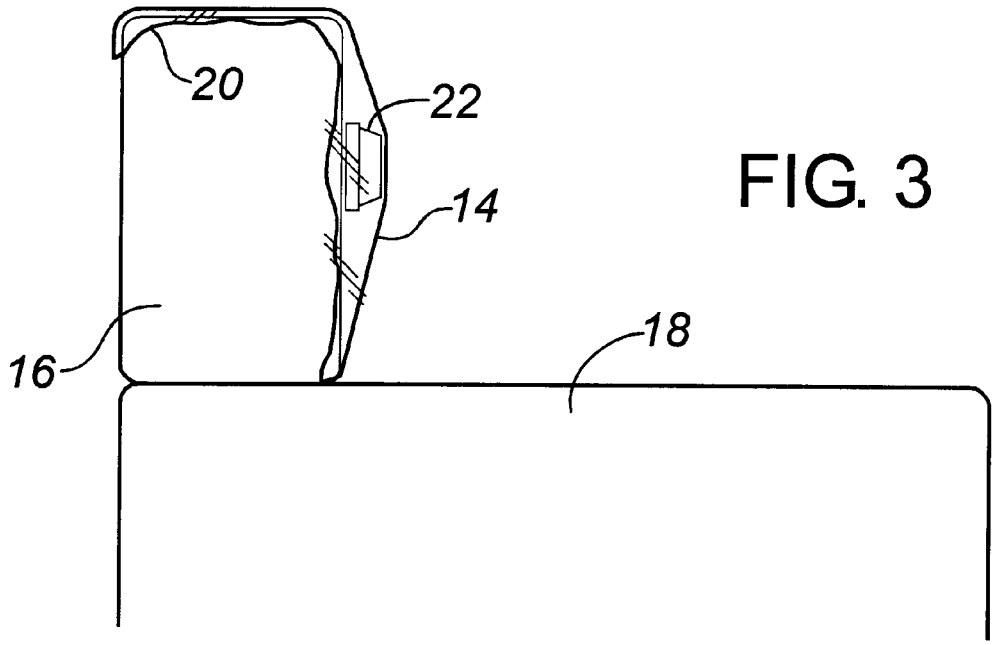
FIG. 3 is an end elevation view of the stove control panel guard illustrated in FIG. 1, secured to the stove top control panel by inherent cling qualities.
Figure 4:
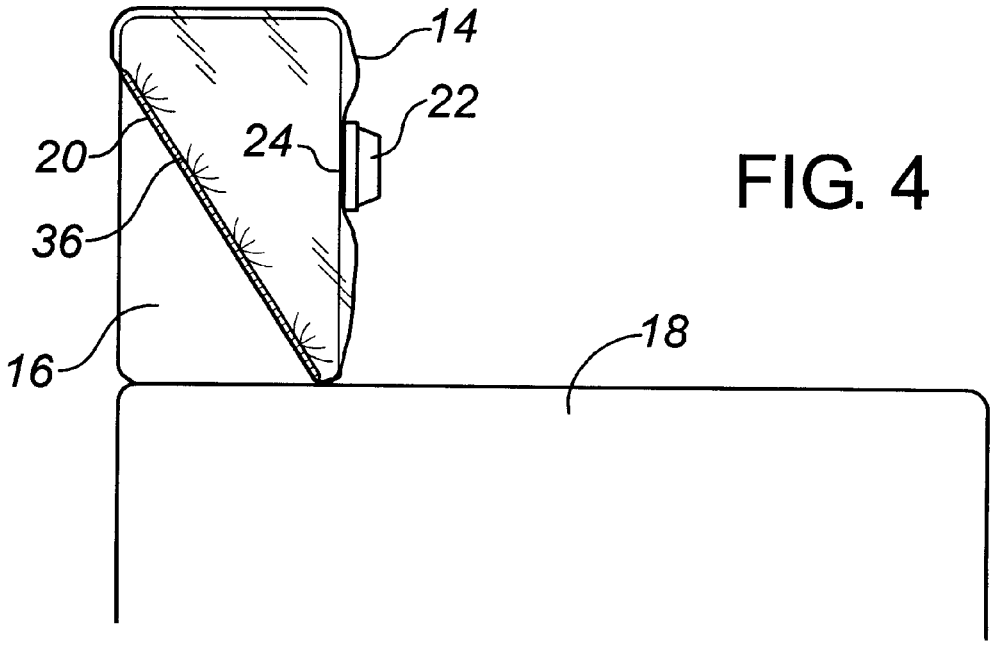
FIG. 4 is an end elevation view of the stove control panel guard illustrated in FIG. 1, secured to the stove top control panel by elasticized peripheral edge.
Figure 5:
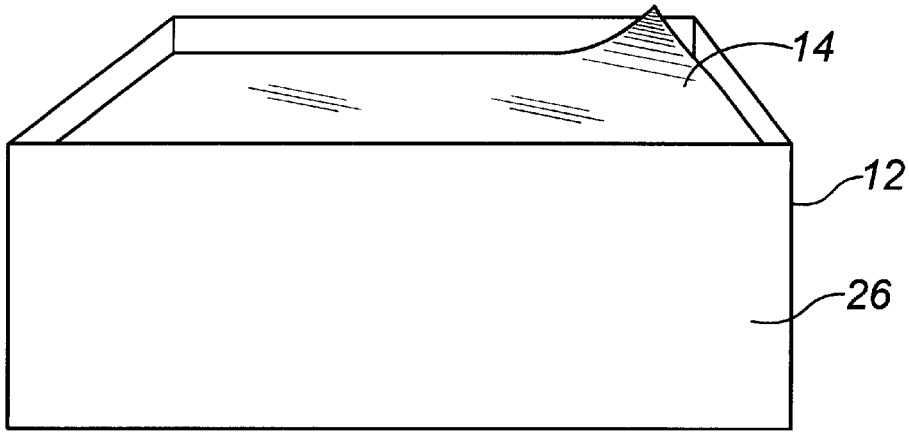
FIG. 5 is a perspective view of the stove control panel guard illustrated in FIG. 1, dispensed in a folded condition from a container.

Structure and Relationship of Parts:

Referring to FIG. 5, stove control panel guard 10 is sold in a container 12 which contains a plurality of flexible transparent heat resistant polymer films 14. Referring to FIG. 1, films 14 are adapted to conform to an underlying form such as a stove control panel 16 on a stove 18. Each of films 14 is precut to dimensions substantially the same as stove control panel 16. Each of films 14 has peripheral edges 20 that are adapted to adhere to an underlying surface such as stove control panel 16. Films 14 are transparent to allow for viewing of stove control panel 14. Although some stove control panels are available with touch controls, most are equipped with knobs 22. Referring to FIGS. 2 and 3, there is illustrated how films 14 can conform to control panel 16 making allowance for knobs 22. Films 14 are flexible enough to allow for turning of knobs 22. Referring to FIG. 4, in the alternative, openings 24 can be provided in film 14 such that knobs 22 can be inserted through openings 24 in film 14 for ease of access.

Figure 6:
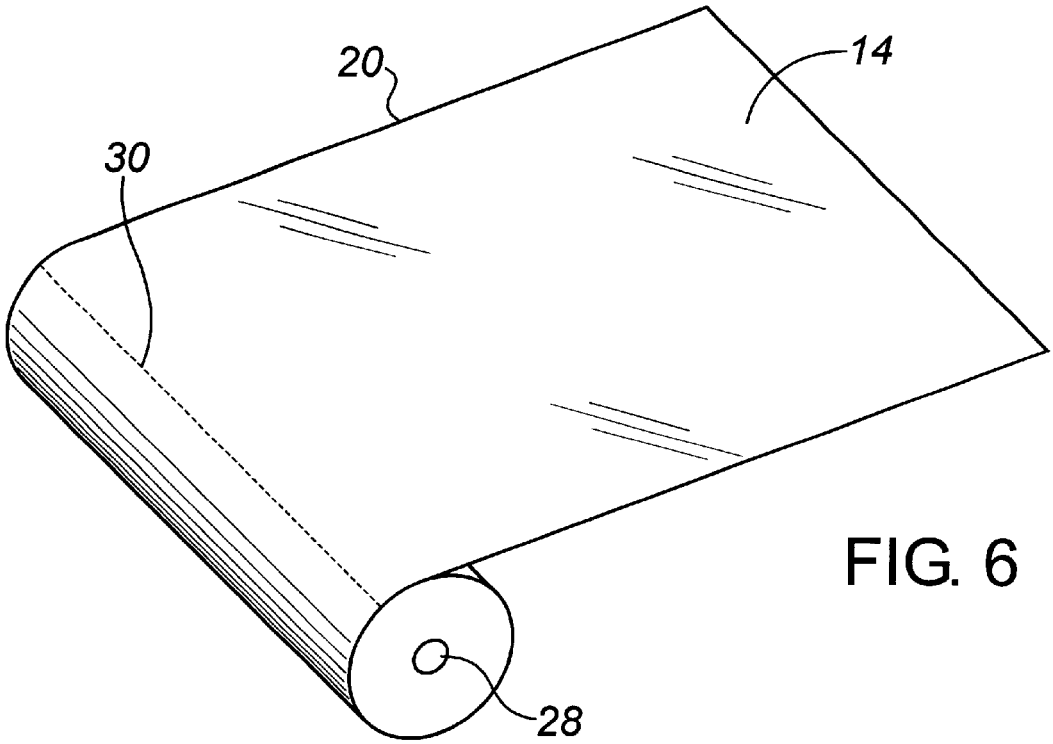
FIG. 6 is a perspective view of the stove control panel guard illustrated in FIG. 1, dispensed from a roll.

The apparatus 10, as described above, relates to packages of disposable protective films 14 that are adapted for use as stove control panel guards 10. There are various "containers" that can be used in dispensing films 14. Referring to FIG. 5, films 14 can be precut and dispensed from boxes 26 or bags. Referring to FIG. 6, films 14 can also be dispensed in rolls 28 and precut with perforations 30 so that individual protective films 14 can be torn from rolls 28. Referring to FIG. 2, there are various ways in which peripheral edges 20 can be adapted to adhere to stove control panel 16. Films 14 can have adhesive 32 along peripheral edges 20, with adhesive 32 being covered with strips 34 until required. Referring to FIG. 3, film 14 can have "cling" qualities, so that when stretched into position film 14 clings to stove control panel 16. Referring to FIG. 4, alternatively, peripheral edges 20 of film 14 can be fitted with an elastic 36 to grip stove control panel 16. A further alternative is the use of mating hook and loop tape strips, such as are sold under the Trade Mark "VELCRO".

Operation:

The use of stove control panel guard 10 will now be described with reference to FIGS. 1 through 6 and in accordance with the preferred method for protecting stove control panel 16 from splatter. Referring to FIG. 5, a first step involves providing stove control panel guard 10, as previously described. Referring to FIGS. 2 through 4, a further step involves covering stove control panel 16 with film 14 and securing peripheral edges 20 of film 14 to peripheral edges 38 of stove control panel 16. When splattering occurs, film 14 may be removed from stove control panel 16 and disposed of. Another film 14 can be dispensed to replace soiled film 14 on stove control panel 16.

Although stove control panel guard 10 is described throughout this application as being "disposable", it will be apparent to one skilled in the art that it need not be disposed of after every use. However, the number of times stove panel guard 10 may be used prior to disposal will, of course, depend upon the amount of splattering that has occurred. With heavy splattering, disposal may take place after a single use. With medium splattering, disposal may take place after half a dozen uses. With light or negligible splattering, disposal may not take place until a dozen or more uses.

Polymer films 14 are described throughout this application as being "heat resistant". These heat resistant films are increasingly being used for consumer products. For example, products are currently being sold that are intended to be cooked in their packaging. They are advertised on the basis that they can be "boiled in the bag". There are also products for cooking turkeys, chickens, and roasts in ones oven, sold under the Trade Mark "LOOK BAGS". In order to withstand boiling the films must be capable of withstanding temperatures of at least 100 degree celsius; the temperature at which water boils. A safe margin for error of 20 degrees is preferably provided. The bags made for use in ones oven have marked on their packaging that they are safe to 200 degrees celsius. The material out of which these heat resistant films are made can vary. Some of the consumer products presently on the market are made from a nylon derivative, but there are other materials that have similar properties.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. An apparatus for protecting a stove control panel from splatter, comprising:

a flexible transparent heat resistant polymer film adapted to conform to an underlying form, the polymer film being precut to dimensions substantially the same as the stove control panel, the polymer film having peripheral edges adapted to adhere to an underlying surface.

2. The apparatus as defined in claim 1, wherein a plurality of the polymer films are dispensed from a container.

3. The apparatus as defined in claim 1, wherein a plurality of the polymer films are dispensed from a roll, the polymer films being separated by precut perforations.

4. The apparatus as defined in claim 1, wherein the peripheral edges of the polymer film are coated with adhesive covered by disposable protective strips.

5. The apparatus as defined in claim 1, wherein the peripheral edges of the polymer film have an inherent cling quality.

6. The apparatus as defined in claim 1, wherein an elastic is positioned along the peripheral edges of the polymer film.

7. The apparatus as defined in claim 1, wherein the polymer film is capable of withstanding temperatures of at least 100 degrees celsius.

* * * * *